US005509288A

United States Patent [19]

Ohno et al.

[11] Patent Number: 5,509,288

[45] Date of Patent: Apr. 23, 1996

[54] FORMING ROLLER FOR CORRUGATED FIN

[75] Inventors: Tetuo Ohno, Nagoya; Yoshitaka Kuroda, Anjo; Hisashi Kobayashi, Kariya; Yoshinobu Matuzaki, Anjo, all of Japan

[73] Assignee: Nippondenso Co., Ltd., Kariya, Japan

[21] Appl. No.: 303,035

[22] Filed: Sep. 8, 1994

[30] Foreign Application Priority Data

Sep. 8, 1993 [JP] Japan ..... 5-223696

[51] Int. Cl.[6] ..... B21D 15/00; B21D 13/00

[52] U.S. Cl. ..... 72/186; 72/196

[58] Field of Search ..... 72/186, 196, 102, 72/108

[56] References Cited

U.S. PATENT DOCUMENTS

| | | | |
|---|---|---|---|
| 3,673,846 | 7/1972 | Levington et al. . | |
| 3,850,018 | 11/1974 | Drosnin . | |
| 3,998,600 | 12/1976 | Wallis . | |
| 4,067,219 | 1/1978 | Bianchi et al. | 72/186 |

FOREIGN PATENT DOCUMENTS

| | | | |
|---|---|---|---|
| 55-110892 | 8/1980 | Japan . | |
| 60-184427 | 9/1985 | Japan . | |
| 62-29136 | 7/1987 | Japan . | |
| 0118318 | 5/1989 | Japan | 72/186 |

*Primary Examiner*—Lowell A. Larson
*Assistant Examiner*—Rodney A. Butler
*Attorney, Agent, or Firm*—Cushman, Darby & Cushman

[57] ABSTRACT

Forming rollers having a tooth tip concave portion at the tip of a tooth tip portion, a tooth bottom convex portion at a bottom of a tooth bottom portion and louver cutter at an oblique line portion between the tooth tip portion and the tooth bottom portion. A radius of an arc-shaped portion of the tooth tip concave portion at front side of rotational direction is set to be larger than a radius of an arc-shaped portion of the tooth tip concave portion at a rear side of the rotational direction. A radius of an apex portion of the tooth tip portion at the front side is set to be smaller than a radius of an apex portion of the tooth tip portion at the rear side and louver cutter at the oblique line portion is formed to have a predetermined interval from the apex portions of tooth tip portion. Therefore, flat folded portions having substantially the same curvature at both shoulder portions thereof horizontal are formed.

6 Claims, 5 Drawing Sheets

FORMING ROLLER FOR CORRUGATED FIN

CROSS REFERENCE TO RELATED APPLICATIONS

This application is based on Japanese Patent Application 5-223696, filed in Japan on Sep. 8, 1993, from which priority is claimed. The content of this document is incorporated hereinto by reference.

BACKGROUND OF THE INVENTION

1. Field of the Invention

The present invention relates to a method of forming rollers for producing corrugated fins utilized in heat exchangers for air conditioners or radiators, etc.

2. Description of the Related Art

Conventionally, the corrugated fins utilized for heat exchangers have a folded portion with an arc-shape. The corrugated fin having the arc-shaped folded portion was decreased contact area with a flat tube disposed so as to contact both side of the folded portion when assembled. Consequently, heat transmission efficiency between the corrugated fin and the flat tube is decreased and the resistance to air flowing between the corrugated fin is increased.

To solve the above problems, a corrugated fin having a folded portion, which is shaped flat, is suggested in Japanese Patent Unexamined Publication (KOKAI) 55-110892. The corrugated fin having a flat folded portion is formed by a pair of forming rollers, with one being shown in an enlarged view in FIG. 4. Forming roller 20 has concave portion 21 at the tip of the tooth and convex portion 22 at the bottom of the tooth. The corrugated fin is machined by making fin material pass through an engaged and rotated pair of forming rollers 20. Concave portion 21, shapes an arc having a predetermined radius r. Louver cutters 23 are entirely formed on the oblique lines between concave portions 21 and convex portions 22.

When a corrugated fin is formed by a pair of forming rollers 20, 20, the formed corrugated fin has flat folded portion 26 slants as shown in FIG. 7. Each curvature, at both ends of the folded fin, is different on the left and right sides, so that enough contact area between the corrugated fin 25 and a tube can not be secured.

As shown in FIG. 5, the pair of forming rollers 20, 20 engage together and rotate together in the direction of the arrow. Fin material W is machined (or formed, processed) by passing through the pair of rollers 20, 20. Fin material W pinched between concave portion 21 of tooth tip and convex portion 22 of tooth bottom is push up at "a" in FIG. 5 by convex portion on 22, so that a strong tension is caused at fin material W. Therefore, the portion "a" of fin material W receives a strong burnish operation (operation to strongly rub surface). At this time at "b" portion, louvers have been completely cut on fin by louver cutter 23. At "c" portion, fin material W is still on louver cutter 23 and louvers have not been completely cut yet.

Next as shown in FIG. 6 at "d", louvers are completely cut and fin material W is drawn, so that the tension is released and burnish operation by convex portion 22 is decreased. Like this, fin material W receives burnish operation strongly only at right side (front side of rotational direction) thereof between concave portion 21 and convex portion 22. When the tension operates to fin material W, flat folded portion is formed. Portion "b" is bent at the side of forming roller and portion "c" is bent on louver cutter 23.

Consequently, both shoulder portions at flat folded portion of formed fin material do not have the same curvatures. A rotational side (forming directional side) shoulder has larger curvature than the other side shoulder. Accordingly, as shown in FIG. 7, formed corrugated fin has a slanted, flat folded portion 26.

SUMMARY OF THE INVENTION

An object of the present invention is to provide forming rollers for corrugated fin enabling formation of an excellently shaped corrugated fin having a horizontal flat folded portion with substantially the same curvature at both shoulder portions.

To achieve the above object, the forming rollers of the present invention comprise tooth tip portions having tooth tip concave portions at the tip thereof. The tooth tip concave portions are formed from first and second arc-shaped portions having a first radius at the front side of the rotational direction by the forming roller and a second radius at the rear side of the rotational direction of the forming roller, the first radius being larger than the second radius. Further, the tooth tip concave portion has first apex portion at the front side of rotational direction and second apex portion at the rear side of rotational direction. A radius of the first apex portion is smaller than a radius of the second apex portion. Tooth bottom portions have tooth bottom convex portions at the bottom thereof and are disposed alternately with tooth tip portions. Louver cutters, for cutting louvers are disposed at an oblique line portions between the tooth tip portions and the tooth bottom portions the louver cutters at the oblique line portions being formed to have a predetermined interval from each the apex portions.

The corrugated fin is formed by utilizing a pair of forming rollers having such a constitution. The pair of forming rollers are disposed to engage and rotate each other. Fin material of thin metal plate is fed into the pair of rollers. The tooth tip portion of a first forming roller engages the tooth bottom portion of a second forming roller alternately. Fin material is pinched between the first and second rollers. Louvers are cut by louver cutter on the oblique line portion. The corrugated fin is thus produced by engagement of the tooth tip and bottom portions. The concave portion of the tooth tip portion and the convex portion of the tooth bottom portion engage to pinch fin material therebetween. By rotation of the rollers, a flat folded portion is formed. Since a radius of an arc-shaped of a concave portion towards the front of the rotational direction is bigger than a radius of an arc-shaped of a concave portion at the rear side of the rotational direction, convex portion of the tooth bottom portion push up fin material with delay. Therefore a position to push up fin material slides to rear side of rotational direction. Fin material between the concave portion and convex portion receives burnish operation at its center area, not at front side of rotational direction.

At an apex portion of the tooth tip portion at front side of rotational direction, tension operates on fin material. The louvers are not completely cut. A flat folded portion of the fin material is formed by a portion, which extends between the apex portion at front side of rotational direction and the end of louver cutter. A radius of the apex portion at front side of rotational direction is smaller than a radius of the apex portion at rear side of rotational direction. Since the louver cutter on the oblique line portion is formed with a predetermined interval from the apex of the tooth tip portion, the fin material is not folded by only the louver cutter at the front side of rotational direction conventionally, and the fin material is folded with each curvature of each shoulder portion of the flat folded portion being substantially the same.

BRIEF DESCRIPTION OF THE DRAWINGS

Other objects, features, and advantages will be clear as well as the functions of related parts, after review of the following detailed descriptions, the appended claims and drawings, all of which form a part of the specification. In the drawings:

DETAILED DESCRIPTION OF THE PREFERRED EMBODIMENT

Figure 1:
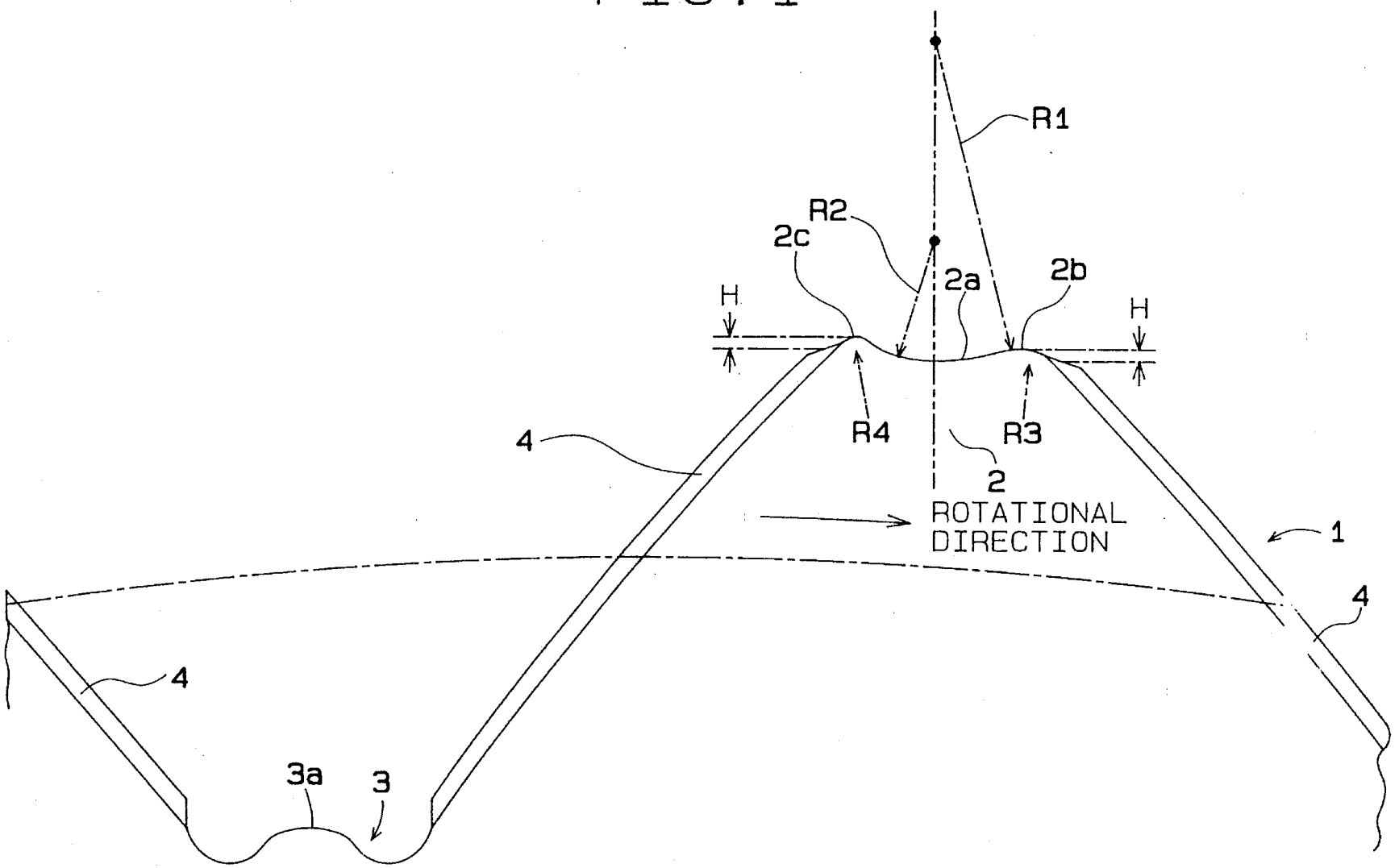
FIG. 1 is a partially enlarged front view of a forming roller of an embodiment of the present invention.
Figure 8:
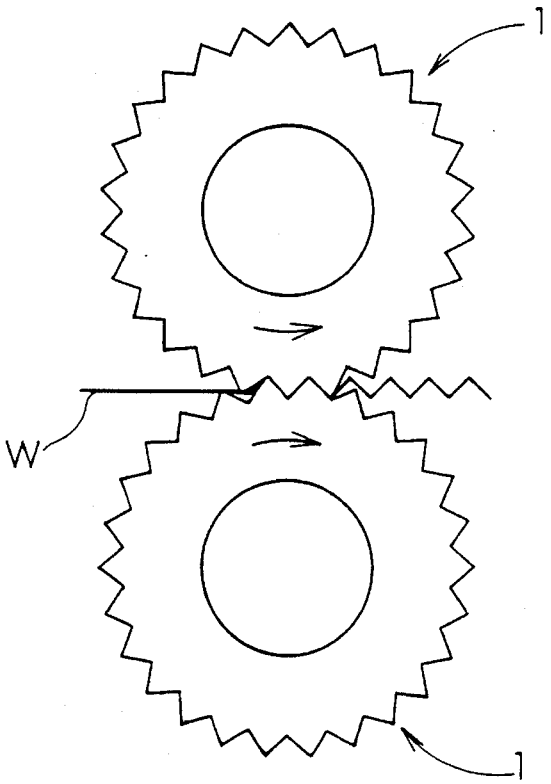
FIG. 8 is a schematic view of forming corrugated fin by a pair of forming rollers.

The present invention relates to paired forming rollers for producing a corrugated fin. The corrugated fin is utilized for a core portion of heat exchanger, such as a radiator having a core portion consisting of a plurality of flat tubes and a plurality of corrugated fins disposed alternately between an upper and a lower tanks. A pair of forming rollers 1, 1 are shown in FIG. 8. Fin material W made of a thin metal plate is fed between the rollers. Fin material W is corrugated as it passes through the rollers. FIG. 1 shows a partial enlargement front view of forming roller 1 for corrugated fin. Forming roller 1 has tooth tip portion 2 and tooth bottom portion 3 formed alternately and continuously at the outer periphery of roller 1 and has louver cutter 4 for forming louver cut with helical shape at an oblique line portion between tooth tip portion 2 and tooth bottom portion 3.

Tooth tip portion 2 has tooth tip concave portion 2*a*. Tooth bottom portion 3 has tooth bottom convex portion 3*a*. A radius R1 of arc-shaped portion of tooth tip concave portion 2*a* at front side of rotational direction is formed to be larger than a radius R2 of arc-shaped portion of tooth tip concave portion 2*a* at rear side of rotational direction. Tooth tip portion 2 has apex portion 2*b* at front side of rotational direction and apex portion 2*c* at rear side of rotational direction. A radius R3 of apex portion 2*b* is smaller than a radius R4 of apex portion 2*c*. A louver cutter 4 formed at an oblique line portion is formed with a predetermined interval H from apex 2*b* and apex 2*c* of tooth tip portion 2. In other words apexes 2*b* and 2*c* protrude from the tip of louver cutter 4 by the interval H.

When a corrugated fin is formed by forming roller having the above constitution, fin material W formed of a thin metal plate is passed between the pair of forming rollers 1, which are disposed to engage each other and rotate. Tooth tip portion 2 of one forming roller 1 engages tooth bottom portion 3 of the other forming roller 1. Fin material W is pinched between the engaged rollers. Louvers are cut on fin material W by louver cutter 4 of the oblique line portion and corrugated fin is formed by an engagement of tooth tip portion 2 and tooth bottom portion 3.

Figure 2:
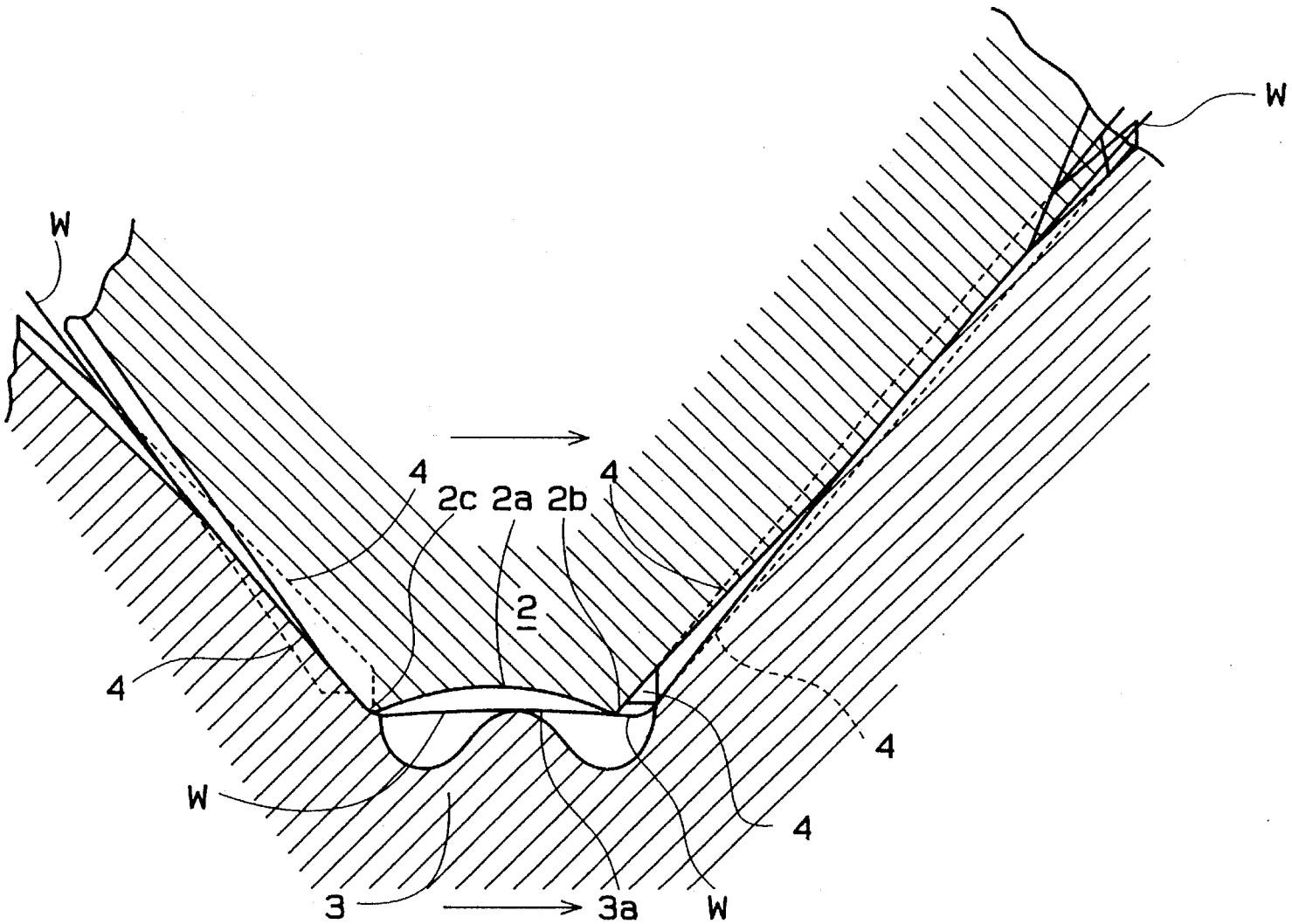
FIG. 2 is a partially enlarged cross sectional view of engaged forming rollers of an embodiment.

An engaging state by the pair of rollers is described as follows. As shown in FIG. 2, tooth tip concave portion 2*a* of tooth tip portion 2 engages with tooth bottom convex portion 3*a* of tooth bottom portion 3 in order to pinch fin material W therebetween. A flat folded portion of fin material W is formed. Since radius R1 of arc-shaped portion of tooth tip concave portion 2*a* at the front side of rotational direction is set to be larger than radius R2 of arc-shaped portion of tooth tip concave portion 2*a* at the rear side of rotational direction as shown in FIG. 1, a position where tooth bottom convex portion 3*a* pushes up fin material W is delayed and slid to rear side of rotational direction. Therefore, fin material W between tooth tip concave portion 2*a* and tooth bottom convex portion 3*a* receives a burnish operation around its center, not the front side of the rotational direction.

Since a tension is applied to fin material W, at apex 2*b* of tooth tip portion 2 at front side of rotational direction, louvers are not cut completely. Flat folded portion of fin material W is formed by an extended portion, which extends between apex portion 2*b* and the end of louver cutter 4. A radius of apex portion 2*b* at front side of rotational direction is smaller than a radius of apex portion 2*c* at rear side of rotational direction and louver cutter 4 of the oblique line portion is formed to have a predetermined interval from apexes 2*b* and 2*c*. Therefore, fin material W is not folded on louver cutter 4 at front side of rotational direction as conventional and is folded to have substantially the same curvature at both shoulder portions of the flat folded portion.

In case of forming with substantially the same curvature of both shoulder portions of the flat folded portion, each radius of both apex portions of tooth tip portion 2 is required to be the same in theory. In forming, the flat folded portion is formed under a state that tension is applied to fin material W at rear side of rotational direction. A this moment, the cutting of louvers is finished. Therefore, fin material W is folded by only apex portion 2*c* at rear side of rotational direction.

Figure 3:
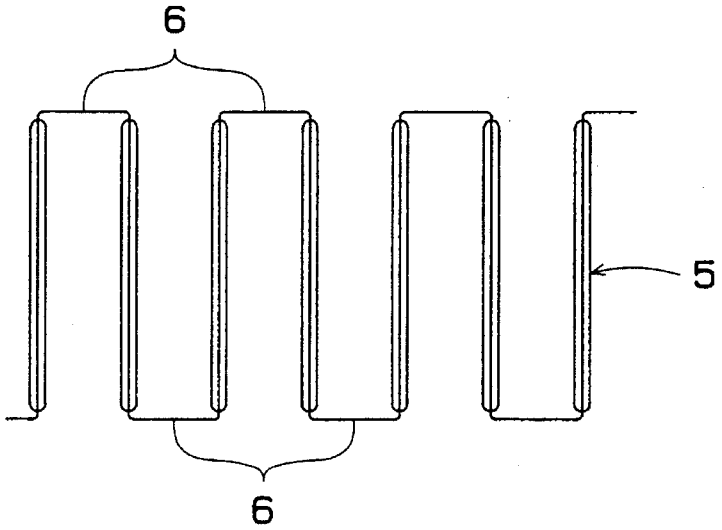
FIG. 3 is a front view of a corrugated fin formed by using the forming rollers of the present invention.
Figure 4:
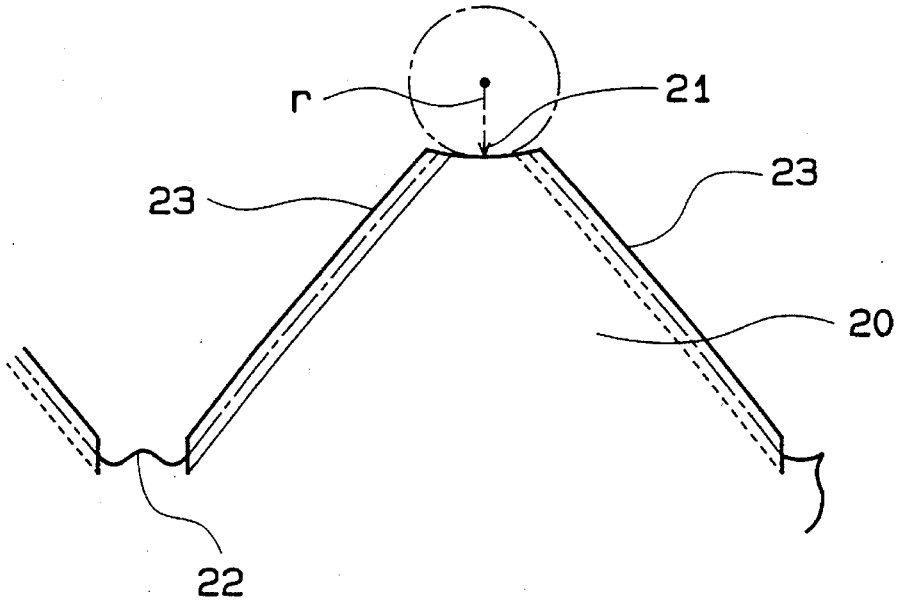
FIG. 4 PRIOR ART
FIG. 4 is a partially enlarged front view of a related forming roller.
Figure 5:
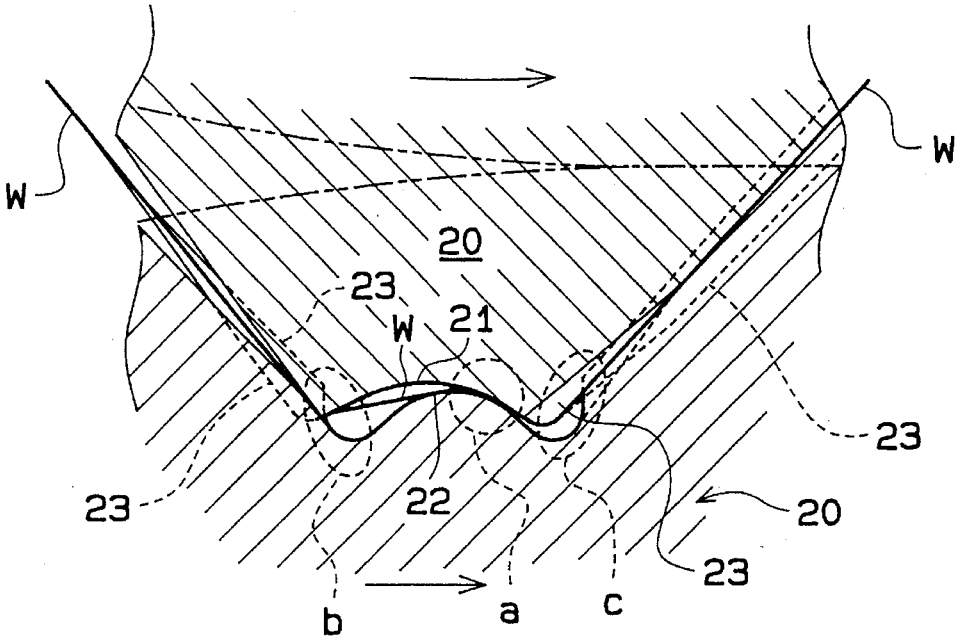
FIG. 5 PRIOR ART
FIG. 5 is a partially enlarged cross sectional view of related engaged forming rollers.
Figure 6:
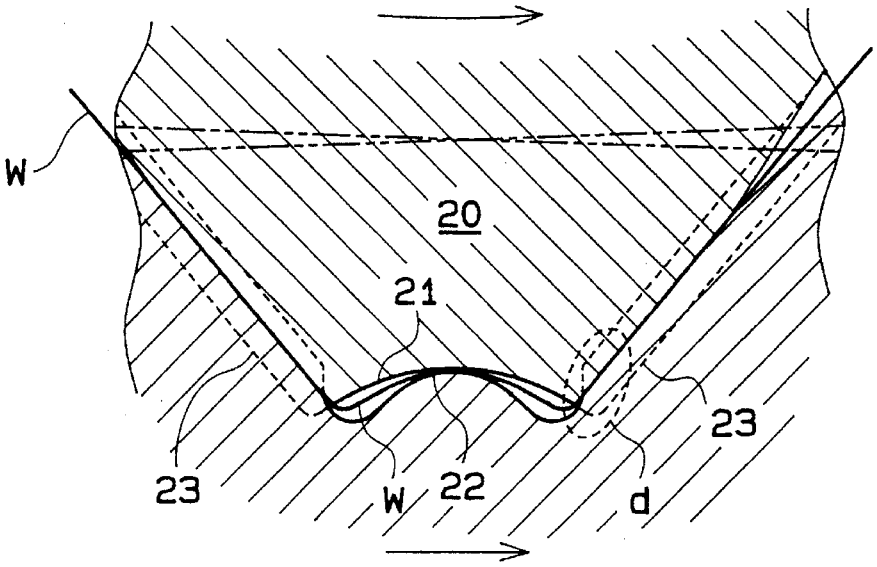
FIG. 6 PRIOR ART
FIG. 6 is a partially enlarged cross sectional view of related engaged forming rollers.
Figure 7:
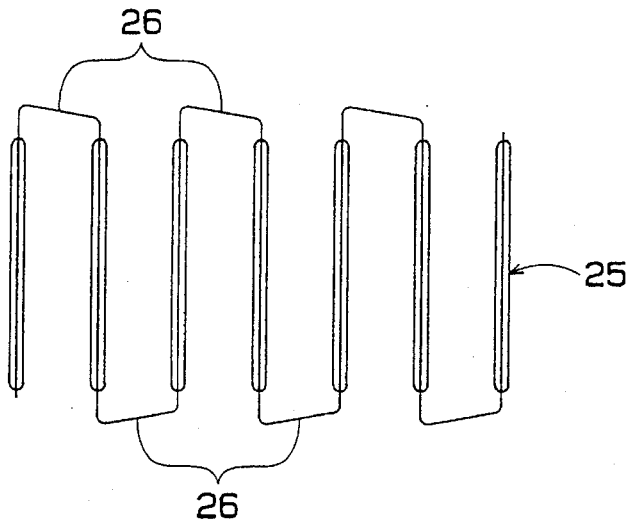
FIG. 7 PRIOR ART
FIG. 7 is a front view of a corrugated fin formed by the related forming rollers.

In the contrary, the cutting of louvers is not finished completely under a state where tension is applied to fin material W at apex portion 2*b*. The flat folded portion of fin material W is formed by the extended portion extended between apex portion 2*b* and the end of louver cutter 4. Therefore, fin material W is folded in order to have substantially the same curvature at both shoulder portions of the flat folded portion. Formed corrugated fin 5 has horizontal flat folded portion 6 which is not slanted as shown in FIG. 3, so that corrugated fin having excellent shape is formed.

When a corrugated fin for heat exchanger for an automotive air conditioner, for example, is produced by paired forming rollers in the present invention, paired forming rollers are accumulated with a predetermined intervals corresponding to intervals of louvers, in other words paired forming rollers are disposed side-by-side across a width of a fin material. Therefore, a number of forming rollers are decided based on a width of the core of the heat exchanger, in other words a number of formed louvers corresponds to a number of parts of forming rollers.

Second apex portion 2*c* is disposed farther from a center of forming roller 1 than first apex portion 2*b*. Second apex portion 2*c* is disposed outer periphery side from first apex portion 2*b*. Therefore, a radius of a first circle made by connecting adjacent first apex portions 2*b* of forming roller 1 is smaller than a radius of a second circle made by connecting adjacent second apex portions 2*c* of forming roller 1.

The present invention has been described in connection with what is presently considered to be the most practical and preferred embodiment thereof. However, the invention is not meant to be limited to the disclosed embodiment, but rather is intended to cover all modifications and alternative arrangements included within the spirit and scope of the appended claims.

What is claimed is:

1. A pair of forming rollers for forming a corrugated fin, each forming roller comprising:

tooth tip portions having tooth tip concave portions at a tip thereof, said tooth tip concave portions being formed from first and second arc-shaped portions having a first radius at a front side of a rotational direction of said rollers, and second radius at a rear side of said rotational direction, said first radius being larger than said second radius, said tooth tip concave portions having a first apex portion at said front side and a second apex portion at said rear side, a radius of said first apex portion being smaller than a radius of said second apex portion;

tooth bottom portions having tooth bottom convex portions at a bottom thereof and being disposed alternately with tooth tip portions;

louver cutters for cutting louvers disposed at oblique line portions between said tooth tip portions and said tooth bottom portions, said louver cutters at the oblique line portions being formed to have a predetermined interval from each said apex portions.

2. A machine for forming a corrugated fin using paired rollers according to claim 1, comprising:

a plurality paired rollers disposed side-by-side across a width of a fin material.

3. A machine for forming a corrugated fin according to claim 2, wherein a number of formed louvers corresponds to a number of parts of said rollers.

4. A pair of forming rollers for forming corrugated fin, each forming roller comprising:

tooth tip portions having tooth tip concave portions at a tip thereof, said tooth tip concave portions being formed from first and second arc-shaped portions having a first radius at a front side of rotational direction of said rollers, and a second radius at rear side of said rotational direction, respectively, said first radius being larger than said second radius, said tooth tip concave portions having a first apex portion at said front side and a second apex portion at said rear, a radius of a first circle made by connecting adjacent first apex portions of said forming roller being smaller than a radius of a second circle made by connecting adjacent second apex portions of said forming roller;

tooth bottom portions having tooth bottom convex portions at a bottom thereof and being disposed alternately with tooth tip portions;

louver cutters for cutting louvers disposed at oblique line portions between said tooth tip portions and said tooth bottom portions, said louver cutters at the oblique line portions being formed to have a predetermined interval from each said apex portions.

5. A pair of forming rollers for forming a corrugated fin for an automotive air conditioner, said pair of forming rollers includes first forming roller and a second forming roller, each forming roller comprising:

tooth tip portions having tooth tip concave portions at the tip thereof, said tooth tip concave portions being formed from first and second arc-shaped portions, which are continuously connected, said first and second arc-shaped portions having a first radius at a front side of rotational direction of said rollers and a second radius at a rear side of said rotational direction, respectively, said first radius being larger than said second radius, said tooth tip concave portions having a first apex portion at said front side and a second apex portion at said rear side to position both ends of said first and second arc-shaped portion, a radius of said first apex portion being smaller than a radius of said second apex portion;

tooth bottom portions having tooth bottom convex portions at the bottom thereof and being disposed alternately with tooth tip portions;

louver cutters for cutting louvers disposed at oblique line portions between said tooth tip portions and said tooth bottom portions, said louver cutters at the oblique line portions being formed to have a predetermined interval from each said apex portions.

6. A pair of forming rollers for forming a corrugated fin, each roller comprising:

a plurality of teeth, each tooth including a tooth tip portion and a tooth bottom portion;

lower cutters formed between said tip portion and said bottom portion;

wherein said tooth tip portion includes first, second, third, and fourth arc-shaped portions, each having a different radii; and wherein said tooth bottom portion includes two concavities which interact with said arc-shaped portions to form said corrugated fin.

* * * * *